US005727458A

United States Patent [19]

Schulz

[11] Patent Number: 5,727,458

[45] Date of Patent: Mar. 17, 1998

[54] METHOD AND APPARATUS FOR CONTOUR MULTI-LEVEL EMBOSSING WITH PERFORATION BONDING IN SELECTED SPACED LOCATIONS

[75] Inventor: Galyn Schulz, Greenville, Wis.

[73] Assignee: James River Corporation of Virginia, Richmond, Va.

[21] Appl. No.: 619,807

[22] Filed: Mar. 20, 1996

[51] Int. Cl.[6] ..... B31F 1/07

[52] U.S. Cl. ..... 101/24; 428/133

[58] Field of Search ..... 101/24, 22, 26, 101/23, 25, 32; 428/154, 133, 137, 156, 172; 493/58, 63, 379–381; 156/209

[56] References Cited

U.S. PATENT DOCUMENTS

| | | | |
|---|---|---|---|
| 2,931,748 | 4/1960 | Muller | 428/137 |
| 3,323,983 | 6/1967 | Palmer et al. . | |
| 3,953,638 | 4/1976 | Kemp | 428/154 |
| 4,307,141 | 12/1981 | Walbrun | 428/132 |
| 4,320,162 | 3/1982 | Schulz | 428/154 |
| 4,543,142 | 9/1985 | Kuepper et al. | 156/209 |
| 4,758,297 | 7/1988 | Calligarich | 156/251 |
| 4,921,034 | 5/1990 | Burgess et al. | 162/109 |
| 5,066,531 | 11/1991 | Legg | 428/131 |
| 5,269,983 | 12/1993 | Schulz | 364/25 |

*Primary Examiner*—Edgar S. Burr
*Assistant Examiner*—Dave Ghatt
*Attorney, Agent, or Firm*—Sixbey, Friedman, Leedom & Ferguson, PC; Charles M. Leedom, Jr.; Donald R. Studebaker

[57] ABSTRACT

An embossing apparatus and method which provides a better embossed appearance and eliminates undesired roughness on the backside of the web material. Two plies are multilevel embossed between rigid engraved rolls and backup rolls, which may be either engraved or smooth. One rigid roll has embossing elements of varying heights and perforation elements, which run in a side-by-side relationship with the corresponding perforation elements on the opposing rigid roll in a nip region of the apparatus. The multiple plies are perforation bonded between the perforation elements, which are preferably the two highest elements, thus reinforcing the other multi-level embossed pattern formed in between the perforation bonds. The embossed patterns impart a quilt-like contoured appearance to the finished product.

23 Claims, 4 Drawing Sheets

FIG.2A
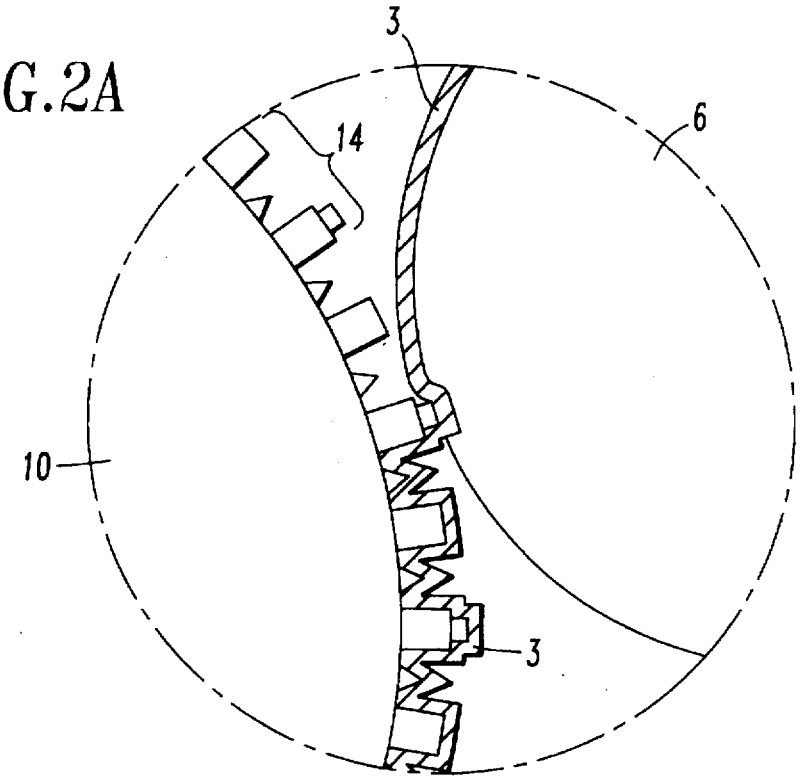
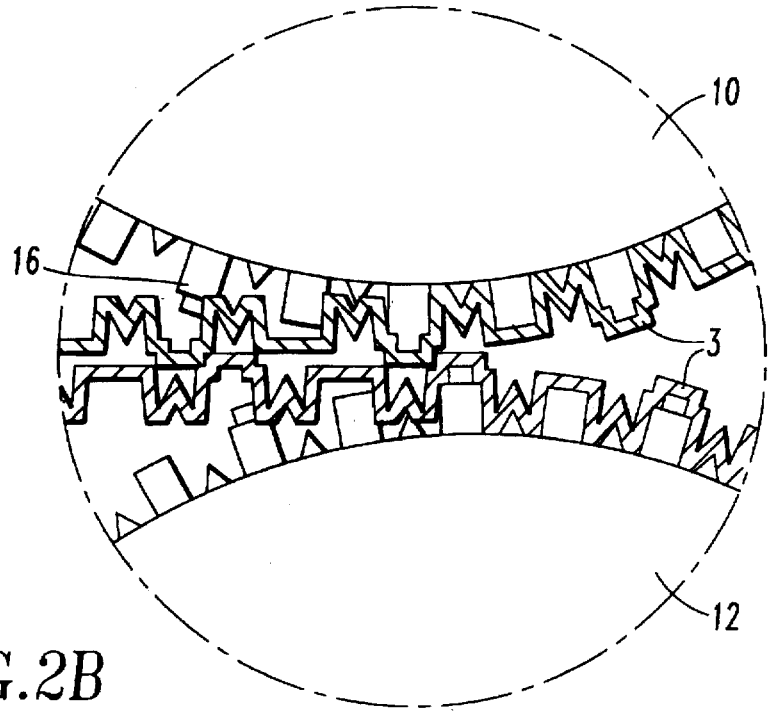
FIG.2B

METHOD AND APPARATUS FOR CONTOUR MULTI-LEVEL EMBOSSING WITH PERFORATION BONDING IN SELECTED SPACED LOCATIONS

TECHNICAL FIELD OF THE INVENTION

The present invention relates to embossing and perforation bonding of paper products, and more specifically to an improved embossing and perforation bonding method and apparatus which provides an exceptional embossed appearance of multi-ply web material and eliminates undesirable roughness.

BACKGROUND OF THE INVENTION

Consumer paper products, such as toilet tissue and paper towels, are constantly being improved to enhance consumer satisfaction, customer loyalty, and product quality. As technology advances, more efforts are being made to simplify the process of making a multi-ply paper product, while at the same time improving the quality of the paper product through various manufacturing methods, such as embossing, which enhance the appearance of the multi-ply paper.

Multi-ply paper products are typically made from two or more identical webs or sheets of paper which are bonded together and rolled onto a paper core. The webs may be bonded together using adhesives which can provide a strong bond between the multiple sheets. This manufacturing process, however, is costly and affects the pliability of the resulting multi-ply product which may cause consumer dissatisfaction in using the product.

When manufacturing a multi-ply paper product, such as toilet tissue, a perforation process is commonly used to form individual multi-ply sheets which allows for dispensing of the sheets when used by a consumer. In addition to the perforation process, the process of embossing the multi-ply web adds a decorative feature which enhances the appearance of the product. Various embossing methods and apparatus are used to yield a consumer paper product having multiple patterns and textures. These methods and apparatus typically use rolls which are engraved with a desired pattern or design. When a multi-ply web material is pressed against the roll, the engraved pattern is embossed onto the web material. The embossing process may be repeated as desired to form a continuous web of material having multiple embossments such as used on toilet tissue and paper towels.

The apparatus disclosed in the prior art perform embossing and/or perforation to yield the desired multi-ply appearance, however, the inventor has recognized that to simplify the manufacturing process, an apparatus capable of perforation bonding which is a process used to bond multiple plies of material together, and multi-level embossing would undoubtedly be desired. The inventor has determined that the multi-level embossing and perforation bonding of a multi-ply web material provides a contoured and three-dimensional appearance which, in essence, results in a product more appealing to a consumer.

The inventor has further recognized that conventional methods for embossing and perforating create a "nobby" backside on the web material due to the embossing elements pushing through the multi-ply material from one side. The "nobby" backside results in an undesirable rough texture that is not very appealing to a consumer. Moreover, the "nobby" backside becomes even more apparent when a multi-level embossing process is employed using various emboss levels. The roughness associated with the above problem not only effects the texture of a multi-ply web but also effects the appearance of the embossed design.

A multi-ply web may be embossed at a various heights to provide the desired embossing design. One such process employing this feature and attempting to overcome the problems associated with having a "nobby" backside is described in U.S. Pat. No. 4,320,162 to Schulz which discloses the use of embossing elements of varying heights to emboss a two-ply web with a pattern of deep and shallow embossments. The web plies in Schulz, however, are bonded by adhesive which adds to the stiffness of the paper web thereby diminishing consumer satisfaction with the resulting paper product.

Another prior art reference which attempts to provide both embossing and bonding is U.S. Pat. No. 3,323,983 to Palmer et al. which discloses running plies of thin creped papers through a pair of embossing wheels which are configured to provide good ply attachment without substantial cutting of the paper material. The reference, nevertheless, does not disclose or teach the multi-level embossing and perforation bonding of a web material to provide a contoured paper product. Moreover, the Palmer et al. design appears to create a multiply paper product having a "nobby" backside.

Other references of interest which address embossing multiple-ply webs are U.S. Pat. No. 3,953,638 to Kemp and U.S. Pat. No. 4,543,142 to Kuepper et al. Neither reference, however, suggests a multilevel embossing apparatus and method for embossing and perforation bonding a multi-ply web material utilizing an integrated pattern design.

In view of the existing prior art, as discussed above, there is a need for a cost effective yet simplified manufacturing system and process that provides multi-level embossing and perforation bonding to multiple plies of web material to yield a consumer paper product having a contoured, three-dimensional quilt-like appearance, without any undesirable roughness.

SUMMARY OF THE INVENTION

It is therefore an object of the present invention to provide an improved embossing and perforation bonding apparatus which yields a better embossed appearance of a multiple ply web material.

It is another object of the present invention to provide an embossing and perforation bonding embossing process which eliminates undesirable roughness of the resulting multiple ply web material.

It is a further object of the present invention to provide an embossing and perforation process having multiple levels of embossments to yield a multiple ply web material having a three-dimensional appearance. It is yet another object of the present invention to provide an embossing and perforation bonding apparatus which creates pattern embossments in a multiple ply web material as well as bonds the material together using perforation bonding technique.

It is also another object of the present invention to provide an embossing and perforation apparatus which can create patterns independent of each other on both sides of the multiple ply web material.

It is also an object of the present invention to provide a method of embossing and perforation bonding which yields a multiple ply product having multiple layers of embossments to create a quilt like and contoured appearance.

These and other objectives are achieved by an embossing and perforation bonding apparatus and method which provides an improved embossed appearance and eliminates any undesirable roughness associated with embossing. The embossing and perforation bonding apparatus embosses multiple plies of web material between rigid engraved rolls and rubber backup rolls, which can be laser engraved or solid. One rigid roll has embossing elements of varying heights to perform multi-level embossing and a perforation element which runs in a side-by-side relationship with the corresponding perforation element on an adjacent rigid roll. The multiple plies are perforation bonded between the perforation elements, which are the two highest elements, thus reinforcing the other multi-level embossment patterns formed in between the perforation bonds. The embossed patterns on the rigid rolls impart a quilt-like contoured appearance to the finished product and can be independent except when the perforating emboss elements must line up for bonding. It should be noted that the rigid embossing roll may also be a laser engraved rubber roll having a shore A hardness in a range of 30 to 110, preferably in a range of 80 to 105 and more preferably approximately 99.

BRIEF DESCRIPTION OF THE DRAWINGS

FIG. 2A is an exploded fragmentary side elevational view of the relationship between the backup and embossing rolls of the roll configuration shown in FIG. 1, having a web material fed therethrough;

FIG. 2B is an exploded fragmentary side elevational view of the relationship between the embossing rolls of the roll configuration, shown in FIG. 1, having a web material fed therethrough;

DETAILED DESCRIPTION OF THE PREFERRED EMBODIMENT

The present invention relates to an apparatus and method for contour multilevel embossing with perforation bonding in selected spaced locations. In the preferred embodiment of the present invention, the embossing apparatus and method is used to manufacture toilet tissue and paper towels. One skilled in the art should recognize, however, that the embossing apparatus and method discussed below could be used for embossing any multi-ply paper product.

Figure 1:
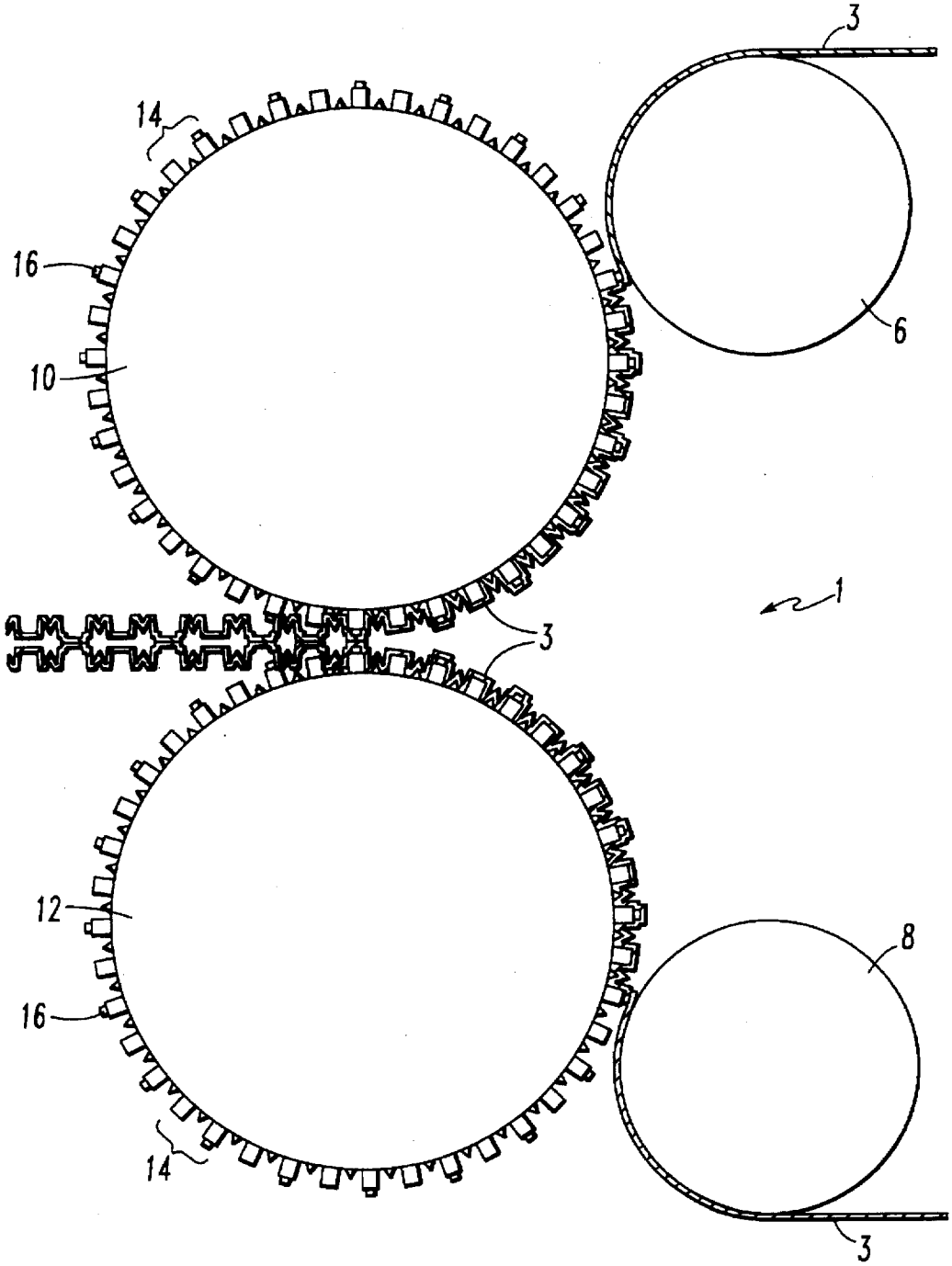
FIG. 1 is a side elevational view of the roll configuration of an embossing apparatus in accordance with the preferred embodiment of the present invention.

FIG. 1 illustrates a roll configuration 1 of an embossing apparatus (not shown) in accordance with the preferred embodiment of the present invention. Roll configuration 1 comprises a plurality of rolls used for feeding as well as embossing and perforation bonding multiple plies of web material. Roll configuration 1, as illustrated, includes two rubber emboss backup rolls 6 and 8 which guide the web material 3 through an embossing apparatus. Also, included in roll configuration 1 are two embossing rolls 10 and 12 which are used to emboss as well as to perforation bond multiple plies of web material therebetween. Each of the rubber emboss backup rolls 6 and 8 and embossing rolls 10 and 12 rotate on a motorized axis (not shown) such that each roll moves in a synchronous motion with respect to the other rolls.

Roll configuration 1 of FIG. 1 comprises an upper rubber backup roll 6 and a lower rubber backup roll 8. The upper backup roll 6 rotates counter-clockwise on its axis while lower backup roll 8 rotates clockwise. The backup rolls are comprised of rubber in the preferred embodiment, however, any material having similar characteristics may be used. Moreover, in the preferred embodiment, two rubber rolls are used, however, this number may vary depending on the amount of plies being fed through the embossing apparatus.

Roll configuration 1 further includes an upper embossing roll 10 and a lower embossing roll 12. These rolls are comprised of steel, however, a laser engraved rubber roll having a shore A hardness in a range of 30 to 110, preferably in a range of 80 to 105 and more preferably approximately 99 may be substituted for the steel embossing rolls 10 and 12. Particularly, embossing rolls of the type disclosed in U.S. Pat. No. 5,269,983, and assigned to the assignee of the subject invention, the contents of which are hereby incorporated herein by reference, may be used. Upper embossing roll 10 rotates clockwise about its axis whereas lower embossing roll 12 rotates in a counter clockwise motion about its axis. Embossing rolls 10 and 12 include a series of embossing elements 14 having different lengths which protrude from the embossing roll body. A pattern of these embossing elements is formed on embossing rolls 10 and 12 to create a desirable embossing design. Embossing elements 14 may be configured in any pattern which may vary between each embossing roll. The pattern of embossing elements 14 dictates the design embossed into the web material 3. Embossing rolls 10 and 12 are in an abutting relationship wherein embossing elements 14 interfere with each other when the rolls are rotated thereby forming a nip between such rolls. This interference creates embossments on web material 3 fed in between upper embossing roll 10 and lower embossing roll 12 and more importantly provides for perforation bonding of the multiple ply web material.

FIGS. 2A and 2B illustrate a fragmentary side elevational view of the relationship between the embossing rolls and between the feeding and embossing rolls of roll configuration 1 noted in FIG. 1. In particular, FIG. 2A illustrates the interfering relationship between embossing roll 10 and backup roll 6. The backup roll 6 has a certain resilience which allows embossing elements 14 to push into the surface of backup roll 6 as the respective rolls rotate in a synchronous fashion. As a single ply of web material is fed in between embossing roll 10 and backup roll 6, the web material is embossed as embossing elements 14 push into surface of the backup roll 6. This creates a pattern in the web material that reflects the pattern of embossing elements on the embossing roll. It should be appreciated that the resilient backup roll may be a laser engraved backup roll to create a mated nip. That is, backup rolls 6 and 8 may include a mirror or complimentary image to that formed on rolls 10 and 12 respectively to create a more pronounced embossing pattern in the web material.

In the preferred embodiment, the backup roll has a smooth surface so the embossed pattern is a shallow reflection of the embossing element pattern on embossing roll 10. However, as noted hereinabove, the backup rolls 6 and 8 may have a mirror image engraving of the embossing pattern on embossing roll 10. This engraving may be performed either by a laser engraving or some other similar engraving process. When an engraved pattern is used on the backup roll to reflect the complimentary embossing pattern on the embossing roll, an embossment having an improve set in the web material results. This improved set adds to the three dimensional effect of the emboss pattern by enhancing the web materials resistance to crushing.

Figure 3A:
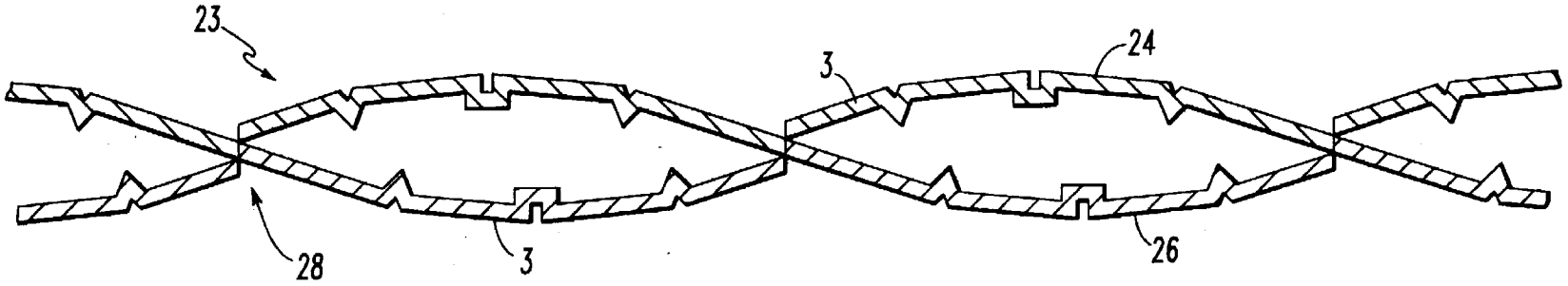
FIG. 3A is a cross-sectional view of a multi-ply web material fed through the embossing apparatus noted in FIG. 1 having the same pattern configuration for the upper and lower plies.
Figure 3B:
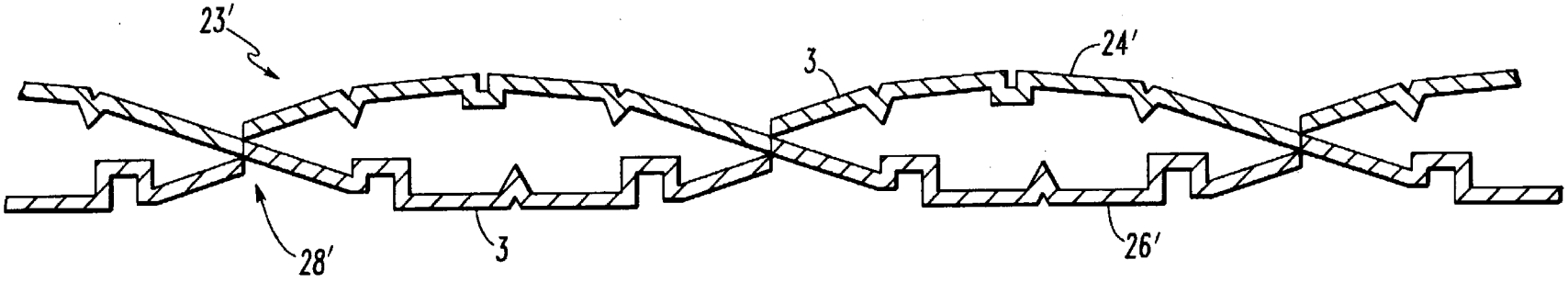
FIG. 3B is a cross-sectional view of a multi-ply web material fed through embossing apparatus having different pattern configurations for the upper and lower plies.

Due to the various heights of the embossing elements, the embossed pattern has a multi-level appearance after being embossed between the embossing roll and the backup roll. As illustrated in FIGS. 2A and 2B, the square embossing elements are higher than the triangular embossing elements. Moreover, the perforation bonding elements extending from the square embossing elements are the highest elements on the embossing roll, thus the resulting pattern would have three levels of embossments which will become apparent from FIGS. 3A and 3B. The highest embossing level would be that created by the perforation blade. The second highest level would be that created by the square embossing element and the third highest level would be created by the triangular element thus forming a pattern which has a three-dimensional appearance. It should be noted that at the nip created between embossing rolls 10 and 12, the elements do not contact point-to-point but align to the side of one another to pinch or rupture the sheet creating a bond between the two plies. Again, this feature is best illustrated in FIGS. 3A and 3B.

It should be further noted that any emboss pattern may be created by the embossing rolls 10 and 12 so long as at selected regions, the perforation elements interfere with one another in the nip region so as to bond the plies together as will be discussed in greater detail hereinbelow.

The interference created between embossing roll 10 and backup roll 6 must be such that the embossing elements do not actually push through the web material. However, care should be taken to ensure that the interference is not too small to avoid embossments which are undesirably shallow. If the interference is too great, the resulting embossments could create a "nobby" backside which has been found to be a problem with the prior art. The desired interference would be such that the embossing elements create a multi-level pattern without actually pushing through the web material. Any rough edges which may be created during the embossing process, however, extend inside the multi-ply web material, thus eliminating any roughness on the outside surface of the resulting paper product. Therefore, the resulting product will be a multi-ply web material having a three-dimensional appearance of embossments due to the multi-levels of embossing on the paper product. One skilled in the art should appreciate that these embossed levels can be varied by adjusting the interference between the embossing rolls and the backup rolls.

During the operation of an embossing apparatus having roll configuration 1, a single ply web material is fed in between backup roll 6 and embossing roll 10 and another between backup roll 8 and embossing roll 12. This step provides the initial embossing of each ply of web material as discussed hereinabove. After each single ply is fed between the respective embossing and backup rolls, it is then fed between the embossing rolls 10 and 12 which provide the perforation bonding necessary to attach both plies of web material together to form a multi-ply paper product which is void of any adhesive and/or adhesive buildup.

The relationship of the embossing rolls is illustrated in FIG. 2B. This figure shows how embossing elements 14 and, in particular, perforation elements 16 on embossing rolls 10 and 12 interfere with each other to create an embossment as well as a perforation bond. The perforation elements of each complimentary embossing roll do not run point to point but side-by-side as noted hereinabove, thereby creating a sufficient interference to perforation bond the multiple plies of web material together. The perforation elements may be arranged such that they bond the multiple ply web material at certain spaced locations which are predetermined and set before the embossing process. The perforation bonds created at these predetermined locations may be spaced such that a consumer is able to separate single or multiple sheets of the multiple ply web material at the perforation bond with relative ease. The perforation bonding occurs when perforation elements 16 press multi-ply web material 3 together as it is fed between embossing rolls 10 and 12. This pressure bond formed by side-by-side alignment of the perforation elements provides a sufficient bonding of the web materials plies such that they are not easily separated.

Embossing roll 10 may have embossing elements arranged in one particular pattern and embossing roll 12 may have embossing elements arranged in a completely different pattern. This would allow the resulting multiple ply web material to have different patterns on each individual multi-ply sheet. However, the perforation elements of rolls 10 and 12 must align side-by-side such that the perforation bond is sufficient to reinforce the multi-level embossments which are made in between each perforation bond. Thus, an adequate pressure must be provided to ensure that the multiple ply web materials are bonded together but also must be strong enough to ensure that the embossments are sufficiently supported to maintain a quilt-like and contoured appearance. Accordingly, the highest bonding elements of the embossing rolls must align side-by-side.

FIGS. 3A and 3B show a multi-ply sheet of web material which has been fed through roll configuration 1, shown in FIG. 1, and discussed above. Specifically, FIG. 3A illustrates a two-ply sheet 23 fed through the above-discussed embossing apparatus and shows a pattern on both the top surface 24 and bottom surface 26 that is substantially identical along the length of web material 3. FIG. 3A further shows the perforation bond indicated at arrows 28 which, as noted above, not only bonds the two plies of web material together but also reinforces the embossments of the separate plies of web material. As is clearly shown in FIG. 3A, the perforation bonding occurs by interfering the perforation elements 16 with one another in the nip region thus interfering the top surface 24 with the bottom surface 26. This is achieved by the side-by-side interference of the perforation elements as discussed hereinabove.

The patterns on the embossing rolls, however, may be different as illustrated in FIG. 3B. As shown in FIG. 3B, the pattern on the top surface 24' of multi-ply sheet 23' is different than the pattern along the bottom surface 26' of the multi-ply web material. This occurs because the pattern on the first embossing roll is different from the pattern on the second embossing roll. Again, the top surface 24' and bottom surface 26' interfere with one another due to the side-by-side interference of the perforation elements in the nip region. In the instant case, the use of different patterns adds to the three-dimensional effect and further improves the appearance and absorbency of the resulting paper ply product. In addition, by perforation bonding the separate plies of web material together, no adhesives or similar additives are necessary to bond the web plies. This results in a paper product that is smooth along its entire surface and does not suffer from stiffness or any other undesirable affects.

Figure 4:
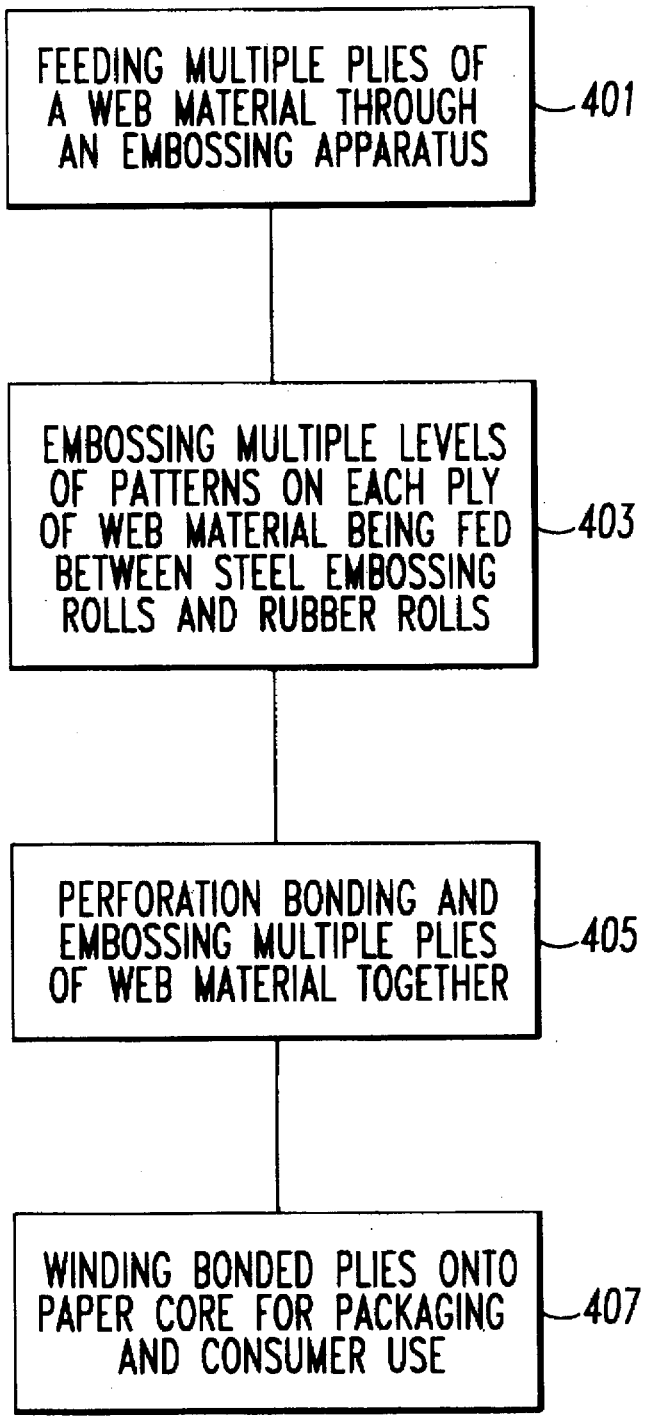
FIG. 4 is a flowchart illustrating the steps of embossing and perforation bonding multiple plies of a web material in accordance with the preferred embodiment of the present invention.

FIG. 4 illustrates the preferred method of the present invention. In manufacturing the multi-ply product shown in FIGS. 3A and 3B, the following method should be employed to ensure that the resulting paper product provides a multi-level embossed appearance having perforation bonds in selected space locations. The process begins by feeding multiple plies of web material through an embossing apparatus as shown in block 401. In the preferred embodiment, a first single ply of web material is fed through one set of embossing and backup rolls and a second single ply of web material is fed through a second set of embossing and backup rolls for the desired embossing effect. More embossing roll and backup roll configurations may be used for additional plies of web material to create a paper product having two or more layers. Block 403 of FIG. 4 includes the step of embossing multiple levels of patterns on each ply of the web material fed between the embossing and backup rolls. These multiple levels of embossments will be a result of the embossing roll pattern. Once the single plies are embossed in block 403, the two plies are fed together between the two rigid rolls for perforation bonding in block 405. Once the multiple plies of web material have been bonded together, the resulting paper product is wound onto a paper core for packaging and consumer use as shown in block 407 of FIG. 4. This process provides a simplified, yet effective, manufacturing process which yields an improved paper product having perforation bonding as well as multi-level embossing to create an appearance and softness that is desirable to a consumer.

Accordingly, as can be appreciated from the foregoing description, the present invention provides a cost effective manufacturing process and apparatus which provides a better embossed appearance and eliminates undesired roughness. Further, the present invention provides an improved embossing and perforation bonding apparatus which yields a better embossed appearance for a multiple ply web material and an embossing and perforation bonding embossing process which eliminates undesirable roughness of the resulting multiple ply web material. Additionally, the present invention provides an embossing and perforation process having multiple levels of embossments to yield a multiple ply web material having a three-dimensional appearance, and provides a perforation bonding apparatus which creates pattern embossments in a multiple ply web material as well as bonds the material together using perforation bonding technique. Accordingly, the above noted embossing and perforation bonding apparatus and method provides an improved embossed appearance and eliminates any undesirable roughness associated with embossing. The embossing and perforation bonding apparatus embosses multiple plies of web material between rigid engraved rolls and rubber backup rolls, which may be laser engraved or solid. One rigid roll has embossing elements of varying heights to perform multi-level embossing and a perforation element which runs in a side-by-side relationship with the corresponding perforation element on an adjacent rigid roll. The multiple plies are perforation bonded between the perforation elements, which are the two highest elements, thus reinforcing the other multi-level embossment patterns formed in between the perforation bonds. The embossed patterns on the rigid rolls impart a quilt-like contoured appearance to the finished product and can be independent except when the perforating emboss elements must line up for bonding. As previously noted, the rigid embossing roll may also be a laser engraved rubber roll having a shore A hardness in a range of 30 to 110, preferably in a range of 80 to 105 and more preferably approximately 99.

While the invention has been described with reference to the preferred embodiment, it should be appreciated by those skilled in the art that the invention may be practiced otherwise than as specifically described herein without departing from the spirit and scope of the invention. It is therefore, understood that the spirit and scope of the invention be limited only by the appended claims.

What is claimed is:

1. An apparatus for providing perforation bonding and embossing of multiple plies of web material, comprising:

at least two backup rolls; and at least two embossing rolls, each of said embossing rolls positioned adjacent a respective one of said backup rolls so as to create an interference between said rolls during rotation to emboss said web material which is fed therethrough, each of said embossing rolls further positioned adjacent to one another so as to create an interference between said embossing rolls for perforation bonding said web material which is fed therethrough in a nip region, said embossing rolls including;

a plurality of embossing elements for forming an embossed pattern in the web material, said embossing elements having at least two different heights arranged in an embossing pattern for embossing said web material; and a plurality of perforation elements, said perforation elements being the highest element on said embossing rolls for perforation bonding and embossing said web material;

wherein said perforation elements of at least two of said embossing rolls interfere with one another in said nip region such that the plies of the web material are perforation bonded to one another.

2. The apparatus as defined in claim 1, wherein said backup rolls are comprised of a rubber material.

3. The apparatus as defined in claim 1, wherein said embossing rolls are comprised of a material more rigid than a material comprising said backup rolls.

4. The apparatus as defined in claim 1, wherein said backup rolls included a pattern for embossing the web material passed therethrough.

5. The apparatus as defined in claim 4, wherein said embossing pattern of each of said embossing rolls are identical to form continuously matched patterns of embossments.

6. The apparatus as defined in claim 1, wherein the surface of said backup rolls is smooth.

7. The apparatus as defined in claim 1, wherein said embossing elements on each of said embossing rolls form different embossing patterns.

8. The apparatus as defined in claim 1, wherein said perforation elements of one of said embossing rolls run side-by-side with the perforation elements of another one of said embossing rolls in said nip region formed between said embossing rolls.

9. An apparatus for providing perforation bonding and multiple levels of embossing of multiple plies of a fibrous web material, comprising:

at least two backup means for directing respective fibrous webs to be embossed and perforation bonded;

at least two embossing means having embossing elements of at least two different heights for embossing said fibrous web material at multiple levels, each of said embossing means positioned adjacent a respective one of said backup means so as to create an interference between said rolls during rotation to create an embossed pattern in said web material which is fed therethrough, each of said embossing means further being positioned adjacent to one another so as to create an interference for embossing said fibrous web material which is fed through a nip region between said embossing means; and a perforation bonding means rigidly attached to said embossing means for creating perforation bonds in said fibrous web material at predetermined intervals to reinforce said embossments formed in said fibrous web material without melting said fibrous web material as said fibrous web material passes through said nip region.

10. The apparatus as defined in claim 9, wherein said backup means comprises backup rolls which rotate to direct said fibrous web material to said embossing means.

11. The apparatus as defined in claim 10, wherein said backup rolls are comprised of a rubber material.

12. The apparatus as defined in claim 9, wherein said embossing means comprises embossing rolls which rotate to emboss and bond said web material being fed therethrough.

13. The apparatus as defined in claim 12, wherein said embossing rolls are comprised of a material more rigid than a material comprising said backup means.

14. The apparatus as defined in claim 10, wherein said backup rolls include a pattern for embossing said fibrous web material passed therethrough.

15. The apparatus as defined in claim 14, wherein said embossing pattern of each embossing roll are identical to form continuously matched patterns of embossments.

16. The apparatus as defined in claim 10, wherein the surface of said backup roll is smooth.

17. The apparatus as defined in claim 9, wherein said embossing means includes a plurality of embossing elements having different lengths and formed into an embossing pattern.

18. The apparatus as defined in claim 12, wherein said perforation bonding means includes a plurality of perforation elements fixedly secured to said embossing rolls.

19. The apparatus as defined in claim 18, wherein said perforation elements of one of said embossing rolls run side-by-side with the perforation elements of another one of said embossing rolls in said nip region formed between said embossing rolls.

20. A method for embossing multiple fibrous plies comprising the steps of:

directing at least two continuous fibrous webs of material through an embossing apparatus;

forming at least two levels of patterns on one of said continuous fibrous webs of material by embossing said material between a first and second roll, said second roll including a plurality of embossing elements;

forming at least two levels of patterns on another one of said continuous fibrous webs of material by embossing said material between a third and fourth roll, said third roll including a plurality of embossing elements; and perforation bonding said at least two continuous fibrous webs of material between said second roll and said third roll to bond said continuous fibrous webs of material to one another.

21. The method as defined in claim 20, wherein the patterns formed on one of said continuous webs of material are substantially the same as the patterns formed on said another one of said continuous webs of material.

22. The method as defined in claim 20, wherein the patterns formed on one of said continuous webs of material are different than the patterns formed on said another one of said continuous webs of material.

23. The method as defined in claim 20, wherein the step of perforation bonding said at least two continuous webs of material includes forming a nip region between at least two embossing rolls and running corresponding perforation elements in a side-by-side relationship in said nip region.

* * * * *